US006093516A

United States Patent [19]

Tavernier et al.

[11] Patent Number: 6,093,516

[45] Date of Patent: Jul. 25, 2000

[54] DRY ELECTROSTATOGRAPHIC TONER COMPOSITION COMPRISING WELL DEFINED INORGANIC PARTICLES

[75] Inventors: Serge Martin Tavernier, Lint; Robert Frans Janssens, Geel; Leo Bernard Alaerts, Boechout; Hans Karl Van Cauwenberghe, Wilrijk, all of Belgium

[73] Assignee: AGFA-Gevaert, N.V., Mortsel, Belgium

[21] Appl. No.: 08/128,245

[22] Filed: Sep. 29, 1993

Related U.S. Application Data

[63] Continuation-in-part of application No. 07/778,974, Dec. 23, 1991, abandoned.

[30] Foreign Application Priority Data

Jun. 28, 1989 [EP] European Pat. Off. ..... 89201695

[51] Int. Cl.[7] ..... G03G 9/00

[52] U.S. Cl. ..... 430/110

[58] Field of Search ..... 430/110

[56] References Cited

U.S. PATENT DOCUMENTS

| | | | |
|---|---|---|---|
| 4,741,984 | 5/1988 | Imai et al. | 430/110 X |
| 4,868,085 | 9/1989 | Aita | 430/110 X |
| 5,041,351 | 8/1991 | Kitamori et al. | 430/110 X |
| 5,066,558 | 11/1991 | Hitake et al. | 430/110 X |
| 5,077,169 | 12/1991 | Inoue et al. | 430/110 |

FOREIGN PATENT DOCUMENTS 62-89851 12/1987 Japan .

OTHER PUBLICATIONS

JP–62–289851, Matsubara et al. English Translation.

*Primary Examiner*—Mark Chapman
*Attorney, Agent, or Firm*—Breiner & Breiner

[57] ABSTRACT

The present invention relates to a toner composition consisting of fusible electrostatically attractable toner particles suitable for development of electrostatic charge patterns. According to the invention, dry electrostatographic toner particles suitable for use in the development of an electrostatic charge pattern and having a particle size distribution showing more than about 80 percent by volume of the toner particles with equivalent particle size diameter of less than about 10 $\mu$m are provided wherein:

(i) the toner particles are blended with fine inorganic microparticles in a concentration of at least 0.1% w/w and at most 5% w/w, the said fine inorganic microparticles being characterized by a product of BET surface (A) in $m^2/g$ times the methanol value (B) fulfilling the relation:
$A \times B > 10{,}000$ (ii) and the ratio of the apparent density over the bulk density of the toner particles satisfies the relation:

$$\frac{\rho_{app}}{\rho_{bulk}} \geq 0.2.$$

8 Claims, No Drawings

DRY ELECTROSTATOGRAPHIC TONER COMPOSITION COMPRISING WELL DEFINED INORGANIC PARTICLES

This is a continuation in part application of U.S. Ser. No. 7/778,974 filed Dec. 23, 1991, now abandoned.

DESCRIPTION

1. Field of the Invention

The present invention relates to a toner composition consisting of fusible electrostatically attractable toner particles suitable for development of electrostatic charge patterns.

2. Background of the Invention

It is well known in the art of electrographic printing and electrophotographic copying to form an electrostatic latent image corresponding to either the original to be copied, or corresponding to digitized data describing an electronically available image.

In electrophotography an electrostatic latent image is formed by the steps of uniformly charging a photoconductive member and imagewise discharging it by an imagewise modulated photo-exposure.

In electrography an electrostatic latent image is formed by imagewise depositing electrically charged particles, e.g. from electron beam or ionized gas onto a dielectric substrate.

The obtained latent images are developed, i.e. converted into visible images by selectively depositing thereon light absorbing particles, called toner particles, which usually are triboelectrically charged.

The transferred image may subsequently be permanently affixed to the substrate by heat, pressure, or a combination of heat and pressure.

In toner development of latent electrostatic images two techniques have been applied: "dry" powder and "liquid" dispersion development.

The "liquid" dispersion development uses very small (usually having a particles diameter smaller than 1 μm) triboelectrically charged light absorbing particles to develop the latent image. The use of such small particles brings about that liquid toners are preferred for high resolution electro (photo)graphy.

Consequently when high resolution is set forth as a prerequisite in a particular electrophotographic process, liquid developer compositions are often used.

Indeed, liquid developer compositions with toner particles having average or median particle sizes as fine as 0.25 μm are known for producing very high resolution electrostatic prints. For those skilled in the art, flocculation can be prevented by optimizing the colloidal forces. Liquid developer compositions suitable for use in developing electrostatic charge patterns are disclosed e.g. in U.S. Pat. Nos. 4,123,374 and 4,138,351 both assigned to Agfa-Gevaert N. V., Mortsel, Belgium.

From an environmetal and a convenience point of view, however, "liquid" toner compositions are to be avoided. Such a liquid toner composition is composed of toner particles and organic liquid carrier. During the fixing step the dielectric solvent carried along with the toner and simultaneously deposited to the electrostatographic print should be evaporated and consequently recycled or disposed of in the atmosphere so as to obtain a dry final print.

In comparison to the dry electrophotographic process, an electrostatographic apparatus employing a liquid developer consequently entails much inconvenience for the customer.

Therefore it is nowadays common practice to use "dry" powder development. In dry development the application of dry toner powder to the substrate carrying the latent electrostatic image may be carried out by different methods known as, "cascade", "magnetic brush", "powder cloud", "impression" or "transfer" development also known as "touchdown" development described e.g. by Thomas L. Thourson in IEEE Transactions on Electronic Devices, Vol. ED-19, No. 4, April 1972, pp.495–511.

In earlier dry development systems, the toner particles showed a particle diameter of around 10 μm. Due to this fact the reolution obtainable with dry development systems has been insufficient. Therefore many attempts to use toner particles with particle diameters well below 10 μm have been disclosed.

In U.S. Pat. No. 3,936,517 a method is described for producing small toner particles with a average particle diameter of about 5 μm.

In U.S. Pat. No. 4,284,701, toner particles are claimed according to a size distribution wherein less than 15% by weight are greater than 16 μm, between 7 and 15 % by weight are less than 5 μm, the remainder being from 5 to 16 μm and wherein the median particle size by weight is from 8 to 12 μm.

In U.S. Pat. No. 4,737,433 toner particles, for use in a dry electrostatographic method, with an average particle diameter lower than 10 μm and with a narrow size distribution are disclosed.

The problems of using dry toner particles with average particle size lower than 10 μm, preferentially lower than about 7 μm have been recognized and dealt with in various ways.

EP 004 748 discloses toner particles with an average particle size ranging from 3 to 8 μm to be used together with carrier materials having a mean particle size between 8 and 24 μm. Avoiding, or removing, those toner particles with an average particle size lower than 3 μm improves carrier life, minimizes background deposits and facilitates the cleaning of the photoreceptor. This document discloses that the use of silica fine particles with the toner can improve the copy quality.

U.S. Pat. No. 4,748,474 discloses the use of toner particles of size not more than 5 μm. By the use of such small toner particles the resolution of the image has been 10 lines/mm while it is 5 lines/mm when the particle size of the toner is approximately 10 μm. In order to avoid sticking of the toner particles to the image bearing member, a lubricant, e.g. zinc stearate, should be added in an amount of at least 0.5 wt %.

European Patent Application 0 255 716 discloses a process for the manufacture of fine toner particles having a uniform spherical particle form. According to said application the volume average particle size by a Coulter Counter method is from 1.0 to 7.0 micron and the number average particle size is from 1.0 to 5.0 micron.

In order to have improved fluidity and charging property, said toner particles are manufactured according to a complex suspension polymerization process.

In U.S. Pat. No. 4,737,433 an electrostatographic process is disclosed wherein toner particles having an average diameter less than 10 micron are used. In this application it is said that fundamental difficulties arise when trying to transfer toner particles having an average diameter less than 10 micron from the image bearing member to the paper support in the electrostatographic transfer station, and suitable remedies are proposed.

In U.S. Pat. No. 4,434,220 it is disclosed that the fine toner particles, disclosed in U.S. Pat. No. 4,284,701, pose problems when used with conventional carrier beads having polytetrafluoroethylene coating thereon. The problems are overcome by coating the carrier beads with a mixed resin of fluorinated resins and unfluorinated resins.

In Japanese Patent Application 85 JP-192711, the formation of sharp images having excellent resolving power by an electrostatographic process is described whereby toner particles with grain size between 1–5 micron are employed. The development of the latent image on the photoconductive drum is executed without contact between the photoconductive drum and the thin developer layer applying means.

In Japanese Patent Application 86 JP-132848 good flowability of toner particles with particle diameter around 10 $\mu$m is assured by mixing fine silica powder to the toner and to provide a toner composition with a ratio of apparent density to bulk density greater than 0.3.

In U.S. Pat. No. 5,041,351 toner particles preferably having a volume average particle size of 7 to 15 $\mu$m are disclosed. A toner with such small toner particles can satisfactory be used in a developer when positivily chargeable resin particles are present together with negatively chargeable silica fina particles. Said silica fine particles should have a BET surface between 70 and 300 $m^2/g$ and a methanol value between 30 and 80.

Although every individual solution to the problems of flowability, cleaning and dusting created by using of dry toner particles with a volume average particle size diameter lower than 10 $\mu$m is workable, there is still room for improvement when toner particles with a particle size distribution centered around 5 to 6 $\mu$m are used in an electro (photo)graphic process.

OBJECTS AND SUMMARY OF THE INVENTION

It is an object of the present invention to provide a dry developer composition comprising toner particles with a volume average particle diameter lower than 10 $\mu$m that exhibit superior performance over the prior art dry developer compositions using such toner particles in terms of overall quality of the final electrostatographic print, and in terms of overall performance in the electrostatographic process.

It is further object of the invention to provide a dry developer composition comprising toner particles with a volume-average particle diameter lower than 10 $\mu$m that makes it possible to achieve higher resolution in the final print than the prior art dry developer compositions using such toner particles. It is still another object of the invention to provide dry developer compositions showing high flowability, easy cleaning and low dusting.

Other objects and advantages of the present invention will become clear from the further description.

According to this invention a dry electrostatographic toner composition is provided comprising toner particles having a particle size distribution showing more than about 80 percent by volume of the toner particles with equivalent particle size diameters of less than about 10 $\mu$m wherein:

(i) said toner particles are blended with fine inorganic microparticles in a concentration of at least 0.1% w/w and at most 5% w/w, said fine inorganic microparticles being characterized by a product of BET surface (A) in $m^2/g$ times the methanol value (B) fulfilling the relation:

$$A \times B > 10{,}000$$

(ii) and the ratio of the apparent density over the bulk density of said toner particles satisfies the relation:

$$\frac{\rho_{app}}{\rho_{bulk}} \geq 0.2$$

DETAILED DESCRIPTION OF THE INVENTION

Using toner particles with a particle size distribution that shows more than about 80 percent by volume of the toner particles with equivalent particle size diameters of less than about 10 $\mu$m to yield high resolution in the finished copy entails problems of flowability, cleaning and dusting of the dry developer composition.

It was surprisingly found that the addition of fine microparticles, exhibiting a specified relation between the specific surface (BET-surface) (A) and the methanol value (B) (which is a measure for the hydrophobicity of the fine microparticle), to a toner composition comprising particles with a particles size distribution of the toner particles that shows more than about 80 percent by volume of the toner particles with equivalent particle size diameters of less than about 10 $\mu$m, not only overcomes the cited problems but also enhances the resolution obtainable in the final copy.

The specific surface (BET-surface) can be measured by a method described by Nelsen and Eggertsen in "Determination of Surface Area Adsorption Measurements by continuous Flow Method", Analytical Chemistry, Vol. 30, No. 8 (1958) 1387–1390.

The methanol value, a measure for the hydrophobicity of the fine microparticles, is measured as follows:
200 mg of the fine microparticles and 50 ml of water are put into a vibration flask of 250 ml and stirred magnetically. Methanol is added at a rate not exceeding 10 ml/5 minutes. The end-point of the titration is determined a the point where all the microparticles are suspended (after a ml of methanol). The methanol value (B) is calculated as:

$$B = \frac{a\ \text{ml} \times 100}{50 + a\ \text{ml}}$$

The fine microparticles to be added to the toner composition may have a BET-surface (A) between 100 and 400 $m^2/g$ and a methanol value (B) between 25 and 70. it was however found that only those fine microparticles of which the product of (A) times (B) exceeded 10,000 were effective. In a preferred embodiment the product of (A) times (B) is larger than 11,000.

The fine microparticles are preferably hydrophobic inorganic fine microparticles e.g. $Al_2O_3$, $TiO_2$, $ZrO_2$ or $SiO_2$. Most preferred is the use of hydrophobic fine microparticles of $SiO_2$. Such microparticles are fumed silica particles that have a smooth, substantially spherical surface and that preferably are coated with a hydrophobic layer such as obtained by methylation. Their specific surface area is preferably in the range of 100 to 400 sq.m/g.

Fumed silica particles suitable for use according to the present invention, with a BET-surface within the specified range and with different degrees of hydrophobicity, are commercially available under the Trade Marks AEROSIL and CAB-O-SIL marketed by Degussa, Frankfurt (M), W.Germany and Cabot Corp. Oxides Division, Boston, Mass., U.S.A. respectively.

The preferred proportions of fumed silica to toner material are in the range of 0.5 to 3% by weight.

The mere addition of fine inorganic microparticles that show a product of BET-surface times methanol value greater than 10,000 to toner particles, with a particles size distribution of the toner particles showing more than about 80 percent by volume of the toner particles with equivalent particle size diameters of less than about 10 $\mu$m, does not bring about the desired qualities of the toner composition according to the present invention.

It has been found that the mixing of toner particles and fine inorganic particles has to be performed in such a way as to produce a toner composition showing a ratio between apparent density ($\rho_{app}$) and bulk density ($\rho_{bulk}$) greater or equal to 0.20. In a preferred embodiment the ratio between apparent to bulk density is larger than 0.25.

The bulk density of the toner particles is measured in accordance with conventional techniques in an apparatus such as the Beckmann Air Comparimeter, model available from Beckmann Instruments, Chemin des Bourdon nr. 52–54, 93220 Gagny, France.

The apparent density of the toner particles is determined according to the following procedure:

100 g of toner particles are shaken for a few minutes in a bottle with a volume of approximately 500 ml and are thereafter put on a vibrating sieve with a diameter of 7 cm, a mesh size of 1 mm, vibrating at a frequency of 50 Hz and an amplitude of 1 mm. The agitated toner particles are fed through the sieve to a flat cylindrical recipient with a height of 1.7 cm and a diameter of 7 cm. After equilibration for 2 minutes the toner particles exceeding the height of the recipient are scraped off and the weight of the toner particles contained in the recipient is determined. The apparent density is then calculated as follows:

$$\rho_{app} = \frac{\text{weight of the toner particles as measured}}{\text{volume of the recipient}}$$

The mixing of the toner particles and the fine inorganic microparticles to yield a toner composition, according to the present invention and showing a ratio of apparent density to bulk density equal or greater than 0.20, can advantageously proceed as follows:

The toner particles and the fine inorganic microparticles are put together in a metal box (with a diameter of 10 cm) containing 100 ceramic balls with average diameter of 9 mm, and density of 2.4 g/cm3. This mixture was then rotated at a speed of 300 rpm, for a period of 30 minutes.

An alternative, very suitable method according to the present invention, which can be used is adding the toner particles and the fine inorganic microparticles to a Janke and Kunkel labor-mill apparatus type IKA M20, rotating at a speed of 20,000 rpm, and thermostabilised at 20° C. This model is available from the Janke and Kunkel GmbH, IKA Labortechnik, D-7813 Staufen, W. Germany.

The toner particles suitable for use in accordance with the present invention can be prepared by selecting and modifying some of the known toner mixing and comminution techniques. As is generally known toner is prepared by subsequently blending and mixing the components in the molten state and after cooling, milling and micropulverizing the resulting mixture. Thereafter so as to obtain toner particles corresponding to predetermined particle-sizes, a suitable particle classification method is employed. Typical particle classification methods include air classification, screening, cyclone separation, elutriation, centrifugation and combinations thereof.

The preferred method of obtaining the very fine toner particles of our invention is by centrifugal air classification.

Suitable milling and air classification results may be obtained when employing a combination apparatus such as the A.F.G. (Alpine Fliessbeth-Gegenstrahlmbhle) type 100 as milling means, equipped with an A.T.P. (Alpine Turboplex windsichter) type 50 G.S., as air classification means, the model being available from Alpine Process Technology Ltd., Rivington Road, Whitehouse, Industrial Estate, Runcorn, Cheshire, U.K. Further air classification can be realised using an A 100 MZR (Alpine Multiplex Labor Zick-zack sichter) as additional classification apparatus, the latter model being also available from Alpine Process Technology Ltd. The size distribution of the so obtained toner particles can be determined in a conventional manner by employing a Coulter Counter type TA II/PCA1, model available from the Coulter Electronics Corp., Northwell Drive, Luton, Bedfordshire, LV 33 R4, United Kingdom.

In the air classification apparatus, air or some other gas is used as transport medium and particles contained in the fluidum are exposed to two antagonistic forces, viz., to the inwardly directed tractive force of the fluidum, and to the outwardly directed centrifugal force of the particle. For a definite size of particles, that is, the "cut size", both forces are in equilibrium. Larger (heavier) particles are dominated by the mass-dependent centrifugal force and the smaller (lighter) particles by the frictional force proportional to the particle diameter. Consequently, the larger or heavier particles fly outwards as coarse fraction, while the smaller or lighter ones are carried inwards by the air as fine fraction. The "cut size" usually depends upon the geometrical as well as operational parameters (dimensions of classification, rotor, rotational velocity, etc.). Adjustment of the cut size may be effected through variation of the above mentioned parameters.

Small polymer toner particles with a narrow size distribution, suitable for use in toner compositions according to the present invention can also be prepared by the "emulsion polymerization" process or by the "polymer suspension" process.

The "emulsion polymerization" process is described e.g. in U.S. Pat. No. 2,932,629, U.S. Pat. No. 4,148,741 and U.S. Pat. No. 4,314,932. In this process a water-immiscible polymerizable liquid is sheared to form small droplets suspended in an aqueous solution that contains a suspension stabilizer and the polymerization proceeds in the suspended droplets to form toner particles.

In the "polymer suspension" process a polymer dissolved in an appropriate organic solvent that is immiscible with water, the resulting solution is dispersed in an aqueous medium that contains a stabilizer, the organic solvent is evaporated and and the resulting particles are dried. As suspension stabilizer it is possible to use silica particles as described in U.S. Pat. No. 4,833,060.

The toner particles used in accordance with the present invention may comprise conventional resin binders such as those disclosed e.g. in European Patent Applications 0 128 569, 0 170 421, and 89200192.6. Interesting examples are disclosed in European patent Application 0 279 960, being copolymers of (1) styrene or styrene homologue, (2) an alkyl acrylate or alkyl methacrylate monomer of which the alkyl chain comprises at least 8 carbon atoms in straight line, and (3) a crosslinking monomer containing at least two ethylenically unsaturated groups, Other interesting resins to be used in the toner particles according to the present invention are partly crosslinked polyesters e.g. those disclosed in published GB 2082788A patent application, being e.g. binder-compositions derived from terephthalic acid that is polycondensed with less than 1 equivalent of an ethoxylated and/or propoxylated "bisphenol A". Further any of the other usual polymeric resins suitable for use as binder in toner particles can be used.

For further optimizing the toner properties other resins or pigments modifying the melt viscosity and/or release agents may be used. In particular when the heated roller fusing process is employed, additional release agent, assisting in the release of the toner melt from the fuser roller, should advantageously be incorporated in the toner composition.

Particularly suited release agents are abhesion promoting compounds, e.g. talcum, silicones, fluor-containing polymers and natural or synthetic waxes.

Suitable fluor-containing vinyl polymers having a particularly low friction coefficient (static friction coefficient with respect to steel below 0.2) for preventing toner offsetting on the fuser roll are described in U.S. Pat. No. 4,059,768.

Particularly suitable for preventing toner-offsetting are waxy polyalkylene resins, more particularly an isotactic polypropylene having an average molecular weight lower than 15,000.

The coloring substance used in the toner particles may be any inorganic pigment (including carbon) or solid organic pigments or dyes, or mixtures thereof commonly employed in dry electrostatic toner compositions. Thus, use can be made e.g. of carbon black and analogous forms thereof, such as lamp black, channel black, and furnace black e.g. SPEZIALSCHWARZ IV (trade-name of Degussa Frankfurt/M, W.Germany) and CABOT REGAL 400 (trade name of Cabot Corp. High Street 125, Boston, U.S.A.).

The addition of colorants may also influence the melt viscosity of the toner and if desired, the addition of colorants may be considered that bring the melt viscosity of the toner in the desired range. The colorants can be added and mixed with the molten toner composition that on cooling is crushed and ground to obtain the desired particle size.

Apart from the above-mentioned coloring agents the use of viscosity regulating pigments can be considered. Interesting types for that purpose are titanium dioxide (rutile), barium sulphate (barite), calcium carbonate (calcite), ferric oxide ($Fe_2O_3$=hematite) and ferrosoferric oxide ($Fe_3O_4$=magnetite), cupric oxide; other magnetic or magnetizable pigments can also be used.

The latter pigments can serve also as coloring substance e.g. in magnetic toners. Therefore, the present invention includes toners wherein one or more coloring substances are present.

The typical solid organic dyestuffs used in electrophotographic toners are the so-called pigment dyes, which include phthalocyanine dyes, e.g. copper phthalocyanines, metal-free phthalocyanines, azo dyes, and metal complexes of azo dyes.

The following dyes in pigment form are given for illustration purposes only: FANALROSA B Supra Pulver (trade name of BASF AG, Ludwigshafen, Western Germany), HELIOGENBLAU LG (trade name of BASF for a metal-free phthalcyanine blue pigment), MONASTRAL BLUE (a copper phthalocyanine pigment, C.I. 74,160). HELIOGENBLAU B Pulver (trade name of BASF), HELIOECHTBLAU HG (trade name of Bayer AG, Leverkusen, Western Germany, for a copper phthalocyanine C.I. 74,160), BRILLIANT CARMINE 6B (C.I. 18,850), and VIOLET FANAL R (trade name of BASF, C.I. 42,535).

The typical inorganic pigments used in electrophotography include carbon black, black iron (III) oxide and mixed copper(II) oxide/chromium(III) oxide/iron(III)oxide powder, milori blue, ultramarine cobalt blue, and barium permanganate. Further can be mentioned: the pigments described in the French Patent Specifications 1,394,061 filed Dec. 23, 1963 by Kodak Ltd. and 1,439,323 filed Apr. 27, 1965 by Harris Intertype Corporation.

The coloring substance is normally used in a concentration range from 5 to 20% by weight, calculated with respect to the total weight of the toner.

Apart from insoluble coloring substances the use of soluble coloring substances can also be considered.

To enhance the chargeability in either negative or positive direction of the toner particles (a) charge control agent(s) is (are) added to the toner particle composition as described e.g. in the published German patent application (DE-OS) 3,022,333 for yielding negatively chargeable toner particles or as described e.g. in the published German Patent application (DE-OS) 2,362,410 and the U.S. Pat. Nos. 4,263,389 and 4,264,702 for yielding positively chargeable toner particles. A very useful charge control agent for offering positive charge polarity is BONTRON N04 (trade name of Oriental Chemical Industries—Japan) being a resin acid modified nigrosine dye which may be used e.g. in an amount up to 5% by weight with respect to the toner particle composition. A very useful charge control agent for offering negative charge polarity is BONTRON S36 (trade name of Oriental Chemical Industries—Japan) being a metal complex dye which may be used e.g. in an amount up to 5% by weight with respect to the toner particle composition.

In the preparation of the toner particles the coloring material and other additives are added to the molten resin and are subjected to kneading until a homogeneous mixture is obtained. After cooling, the solid mass obtained is crushed and ground e.g. in a hammer mill followed by a jet-mill. After this operation, air classification was effected.

For a given charge density of the latent image charge-carrying surface the maximum development density attainable with toner particles of a given size is determined by the charge/toner particle mass ratio, which is determined substantially by the triboelectric charge obtained by friction contact with carrier particles in case of a two-component developer.

The toner compositions of the present invention preferably should be used in combination with carrier particles.

The development may proceed by so-called cascading the toner particles over the imaging surface containing the electrostatic charge pattern or with magnetic brush. The carrier particles may be electrically conductive, insulating, magnetic or non-magnetic (for magnetic brush development they must be magnetic), as long as the carrier particles are capable of triboelectrically obtaining a charge of opposite polarity to that of the toner particles so that the toner particles adhere to and surround the carrier particles.

In developing an electrostatic image to form a positive reproduction of an original, the carrier particle composition and/or toner particle composition is selected so that the toner particles acquire a charge having a polarity opposite to that of the electrostatic latent image so that toner deposition occurs in image areas. Alternatively, in reversal reproduction of an electrostatic latent image, the carrier particle composition and toner particle composition is selected so that the toner particles acquire a charge having the same polarity as that of the electrostatic latent image resulting in toner deposition in the non-image areas.

Useful carrier materials for cascade development include sodium chloride, ammonium chloride, aluminium potassium chloride, Rochelle salt, sodium nitrate, aluminium nitrate, potassium chlorate, granular zircon, granular silicon, silica, methyl methacrylate, glass. Useful carrier materials for magnetic brush development include, steel, nickel, iron, ferrites, ferromagnetic materials, e.g. magnetite, whether or not coated with a polymer skin. Other suitable carrier particles include magnetic or magnetizable materials dispersed in powder form in a binder as described e.g. in U.S. Pat. No. 4,600,675. Many of the foregoing and typical carriers are disclosed in U.S. Pat. Nos. 2,618,441; 2,638,416; 2,618,522; 3,591,503 and 3,533,835 directed to electrically conductive carrier coatings, and U.S. Pat. No. 3,526,533 directed to polymer coated carriers. Oxide coated iron powder carrier particles are described e.g. in U.S. Pat. No. 3,767,477. The U.S. Pat. No. 3,847,604 and 3,767,578 relate to carrier beads on the basis of nickel. An ultimate coated carrier particle diameter between about 30 microns to about 1000 microns is preferred. The carrier particles possess then sufficient inertia to avoid adherence to the electrostatic images during the cascade development process and withstand loss by centrifugal forces operating in magnetic brush development. The carrier may be employed with the toner composition in any suitable combination, generally satisfactory results have been obtained when about 1 part of toner is used with about 5 to about 200 parts by weight of carrier.

The toner compositions of the present invention may be used to develop electrostatic latent images on any suitable electrostatic surface capable of retaining charge, particularly photoconductive layers known in the art including conventional photoconductors. Hot roll fusing of toners is described e.g. in Journal of Imaging Technology, Vol. 11, No. 6, December 1985, p. 261–279 and the heated roller fusing process as well as an electrostatographic apparatus for implementing this process is set forth in detail in the already cited European patent application no. 0 279 960, whereas infra-red fusing is described in U.S. Pat. No. 4,525,455.

The following examples illustrates the invention without, however, limiting it thereto. All parts, ratios and percentages are by weight.

EXAMPLES (i) Preparation of the Toner Particles (T1)

90parts of ATLAC T500 (trade name of Atlas Chemical Industries Inc., Wilmington, Del., USA) being a propoxylated bisphenol A fumarate polyester with a glass transition temperature of 51° C., a melting point in the range of 65° to 85° C., an acid number of 13.9, and an intrinsic viscosity measured at 25° C. in a mixture of phenol/ortho dichlorobenzene (60/40 by weight) of 0.175, 10 parts of Cabot Regal 400 (trade name of Cabot Corp., Boston, Mass., USA) being a carbon black, were introduced in a kneader and heated at 120° C. to form a melt, upon which the kneading process was started. After about 30 minutes, the kneading was stopped and the mixture was allowed to cool to room temperature (20° C.). At that temperature the mixture was crushed and milled to form a powder, which was further reduced in grain size by jet milling. Further, air classification using the above mentioned apparatus was effected.

The size distribution of the toner was then determined in a Coulter Multisizer apparatus with a measuring tube of 30 micron, the results of which are seth forth hereunder in Table 1.

TABLE 1

| | Volume distribution | |
|---|---|---|
| Equivalent diameter in $\mu$m | Frequency in % | Cumulative in % |
| 1.59 | 1.13 | 100.00 |
| 2.00 | 3.44 | 98.88 |
| 2.52 | 10.34 | 95.44 |
| 3.19 | 26.97 | 85.10 |
| 4.01 | 44.79 | 58.13 |
| 5.05 | 11.52 | 13.34 |
| 6.36 | 0.39 | 1.82 |
| 8.01 | 0.29 | 1.43 |
| 10.09 | 0.19 | 1.14 |
| 12.71 | 0.19 | 0.95 |

Analysis of the size distribution showed the following results percentage of particles by volume larger than 3 micron: 88% percentage of particles by volume larger than 4 micron: 58% percentage of particles by volume larger than 5 micron: 15%

(ii) Preparation of the Toner and Developer Compositions

Different toner compositions were prepared by mixing the toner particles T1 with different types of fumed silica microparticles showing different BET-surfaces and methanol values. The mixing was conducted in such a way that toner compositions having different ratios between apparent en bulk density were obtained.

Each of the toner compositions was used in a developer composition with a ferrite carrier (Ni—Zn type), with a magnetisation of 50 EMU/g. The average carrier particle diameter was on or about 65 micron. After addition of the toner particles to the carrier in an amount of 2,5% by weight with respect to the carrier, the developer was activated by rolling in a metal box with a diameter of 6 cm, at 300 revolutions per minute, during a period of 30 minutes, with an apparant degree of filling of 30%.

(iii) Evaluation of the Performance of the Developer Compositions

Each of the developer compositions was used to develop an image of a wedge according to UGRA—Offset-Testkeil 1982 compatible with the FOGRA-PMS-System, edited by the Deutsche Forschungsgesellschaft für Druck und Reproduktionstechnik e.V., Postfach 80 04 69, Streitfeldstrasse 19, D-8000 München. Said wedge exhibits figures consisting of concentric circles with increasing resolution.

The image of such a wedge was projected on an electrophotographic recording element (i.e. an $As_2Se_3$ coated conductive drum, which was positively charged) by a high-quality optical device.

The electrostatically deposited toner was transferred by applying a positive voltage of 3 kV to a metal roll, which was kept in close ohmic contact with the rear side of a paper sheet acting as receiving material whose front side was therefore kept in close contact with the toner image on the photoconductor.

The image-wise transferred toner particles were fed to a radiation fusing device operating with an infra-red light fusing element, such as described in the text of Example 8 of U.S. Pat. No. 4,525,445.

The resolution of each transferred image was evaluated as the width in $\mu$m of the smallest line that was resolved in the final image.

The results of that evaluation, together with the ratio of apparent to bulk density, the BET-surface and methanol value of the fine silica particles and the product of these two parameters are summarized in table 2.

TABLE 2

| Example | 1 $\rho_{app}/\rho_{bulk}$ | 2 BET (A) | 3 MeOH (B) | 4 A × B | 5 Resol ($\mu$m) |
|---|---|---|---|---|---|
| 1 | 0.18 | 200 | 26.5 | 5,300 | 18 |
| 2 | 0.26 | 200 | 53.0 | 11,200 | 10 |
| 3 | 0.29 | 300 | 51.6 | 15,480 | 8 |
| 4 | 0.31 | 380 | 59.8 | 22,724 | 8 |
| 5 | 0.18 | 130 | 39.8 | 5,174 | 16 |
| 6 | 0.20 | 200 | 38 | 7,600 | 16 |
| 7 | 0.23 | 300 | 36.2 | 10,860 | 11 |
| 8 | 0.18 | 200 | 00.0 | 0 | 20 |
| 9 | 0.19 | 200 | 24.2 | 4,840 | 16 |
| 10 | 0.19 | 200 | 18.0 | 3,600 | 16 |
| 11 | 0.22 | 200 | 50.0 | 10,000 | 12 |
| 12 | 0.18 | 200 | 26.5 | 5,300 | 17 |
| 13 | 0.20 | 170 | 45.0 | 7,650 | 15 |
| 14 | 0.20 | 300 | 7.5 | 2,250 | 16 |

Column 1: ratio between apparent density and bulk density $\rho_{app}/\rho_{bulk}$ Column 2: BET-surface (A) of the silica in $m^2/g$ Column 3: Methanol value (B) of the silica Column 4: the product A×B Column 5: Resol is the thickness in $\mu$m of the finest lines on the original testwedge which still were faithfully reproduced on the final copy made in an electrostatographic apparatus, whereby the conventional optical system for illuminating the photoconductive drum is replaced by a high-quality optical device The toner compositions of examples 2, 3, 4, 7 and 11, where both the criterion of the product BET-surface times methanol value and the criterion of $\rho_{app}/\rho_{bulk}$ are fulfilled yield the best resolution. Especially toners 2, 3 and 4 yield excellent results. When neither of the criteria is fulfilled (toner 8) the worst resolution results.

What is claimed is:

1. A dry electrostatographic developer composition comprising (I) carrier particles, and (II) a toner composition, comprising toner particles having a particle size distribution showing more than about 80% by volume of the toner particles with particle size diameter of less than about 10 $\mu$m and inorganic microparticles wherein:

(i) said microparticles are present in said toner composition in a concentration of at least 0.1% by weight and at most 5% by weight with respect to the weight of toner particles (ii) said microparticles being characterized by a product of BET surface (A) in $m^2/g$ times the methanol value (B) fulfilling the relation:

A×B>10,000

(iii) and the ratio of the apparent density over the bulk density of said toner composition satisfies the relation:

$$\frac{\rho_{app}}{\rho_{bulk}} \geq 0.2$$

2. A dry electrostatographic toner composition according to claim 1, wherein said fine inorganic microparticles are characterized by a product of BET surface (A) in $m^2/g$ times the methanol value (B) fulfilling the relation:

A×B>11,000 and wherein the ratio of the apparent density over the bulk density of said toner particles satisfies the relation:

$$\frac{\rho_{app}}{\rho_{bulk}} \geq 0.25.$$

3. A dry electrostatographic developer composition to claim 2, wherein said toner particles have a classified size distribution wherein more than 90% by volume of the toner particles have a diameter larger than 0.5 $\mu$m and smaller than 7 $\mu$m and more than about 50% by volume of the toner particles have a diameter of less than about 5 $\mu$m.

4. A dry electrostatographic developer composition according to claim 2, wherein said inorganic microparticles have a BET-surface $\geqq 150$ $m^2/g$.

5. A dry electrostatographic developer composition according to claim 2, wherein said inorganic fine microparticles have a methanol value $\geqq 40$.

6. A dry electrostatographic developer composition according to claim 2, wherein said inorganic fine microparticles are present in an amount $\geqq 0.5\%$ w/w with respect to the toner weight.

7. A dry electrostatographic developer composition according to claim 6, wherein said inorganic fine microparticles are fumed silica.

8. A dry electrostatographic developer composition according to claim 2, wherein said toner particles comprise a colourant.

* * * * *

UNITED STATES PATENT AND TRADEMARK OFFICE

CERTIFICATE OF CORRECTION

PATENT NO. : 6,093,516
DATED : July 25, 2000
INVENTOR(S) : Serge Tavernier et al.

It is certified that error appears in the above-identified patent and that said Letters Patent is hereby corrected as shown below:

Title page,
Item [57], ABSTRACT,
Line 12, delete "said".

Column 4,
Line 53, "it" should read -- It --.

Column 9,
Line 48, "90parts" should read -- 90 parts --.

Column 10,
Line 16, insert -- : -- between the words "results" and "percentage".

Signed and Sealed this

Tenth Day of May, 2005

JON W. DUDAS
*Director of the United States Patent and Trademark Office*